US012722197B2

(12) United States Patent
Hiraiwa

(10) Patent No.: US 12,722,197 B2
(45) Date of Patent: Sep. 1, 2026

(54) METHOD FOR MANUFACTURING PRESS-MOLDED PART

(71) Applicant: FUTABA INDUSTRIAL CO., LTD., Aichi (JP)

(72) Inventor: Domon Hiraiwa, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 226 days.

(21) Appl. No.: 18/795,610

(22) Filed: Aug. 6, 2024

(65) Prior Publication Data

US 2025/0050404 A1 Feb. 13, 2025

(30) Foreign Application Priority Data

Aug. 10, 2023 (JP) ..... 2023-130879

(51) Int. Cl.

| | |
|---|---|
| ***B21D 22/26*** | (2006.01) |
| ***B21D 22/02*** | (2006.01) |
| ***B21D 22/20*** | (2006.01) |
| ***B21D 37/10*** | (2006.01) |
| ***B21D 53/88*** | (2006.01) |

(52) U.S. Cl.

CPC ..... *B21D 22/26* (2013.01); *B21D 53/88* (2013.01)

(58) Field of Classification Search

CPC ..... B21D 22/26; B21D 22/20; B21D 22/02; B21D 53/88; B21D 37/10

See application file for complete search history.

(56) References Cited

U.S. PATENT DOCUMENTS

| | | | | |
|---|---|---|---|---|
| 11,097,331 | B2 * | 8/2021 | Tanaka | B21D 22/26 |
| 2019/0160510 | A1 * | 5/2019 | Tanaka | B21D 53/88 |
| 2019/0185070 | A1 * | 6/2019 | Ito | B21D 53/88 |
| 2022/0280992 | A1 * | 9/2022 | Ono | B21D 24/04 |

FOREIGN PATENT DOCUMENTS

JP 6265315 B1 1/2018

* cited by examiner

*Primary Examiner* — Mohammed S. Alawadi

(74) *Attorney, Agent, or Firm* — David D. Brush; Westman, Champlin & Koehler, P.A.

(57) ABSTRACT

Provided is a method for manufacturing a press-molded part, the method including: forming an intermediate product by press molding; and forming the press-molded part by performing press molding on the intermediate product. The intermediate product includes: a top panel; a pre-vertical wall; a pre-lateral wall; a pre-bottom wall; and an outward bulge. The press-molded part includes: the top panel; a vertical wall; a lateral wall; a bottom wall; a first ridge line; a second ridge line; a third ridge line; and a convergence portion. The outward bulge is a plate-like portion contiguous with the pre-vertical wall, the pre-lateral wall, and the pre-bottom wall. The outward bulge is deformed by press molding, thereby forming the press-molded part from the intermediate product.

10 Claims, 4 Drawing Sheets

METHOD FOR MANUFACTURING PRESS-MOLDED PART

CROSS-REFERENCE TO RELATED APPLICATIONS

This application claims the benefit of Japanese Patent Application No. 2023-130879 filed on Aug. 10, 2023 with the Japan Patent Office, the entire disclosure of which is incorporated herein by reference.

BACKGROUND

The present disclosure relates to a method for manufacturing a press-molded part by press molding.

As disclosed in the official gazette of Japanese Patent No. 6265315, there is known a technique for forming a groove-shaped part provided with a continuous flange by press molding. What is meant by the continuous flange is a flange that is contiguously provided at one end of the groove-shaped part in an extending direction and at one end thereof in a width direction. There is a bent portion formed at a boundary of a portion to form the end of the groove-shaped part in the extending direction and at a boundary of a portion to form the end thereof in the width direction (hereinafter to be referred to as a ridge line).

In the method disclosed in the official gazette of Japanese Patent No. 6265315, when forming the aforementioned part, an intermediate product provided with the continuous flange and the ridge line is firstly formed from a blank material by press molding. Subsequently, press molding is performed on the intermediate product, thereby forming the groove-shaped part.

SUMMARY

According to the technique disclosed in the official gazette of Japanese Patent No. 6265315, it is possible to reduce occurrence of wrinkles at a peripheral area of the ridge line in the continuous flange. However, it is not possible using the method disclosed in the official gazette of Japanese Patent No. 6265315 to sufficiently disperse a load applied to the intermediate product during press molding, and thus cracks or wrinkles may occur.

In one aspect of the present disclosure, it is desirable to reduce occurrence of cracks or wrinkles during press molding.

In one aspect of the present disclosure, a method for manufacturing a press-molded part comprises; forming an intermediate product by performing press molding on a plate-like shaped material; and forming the press-molded part by performing press molding on the intermediate product. The press-molded part comprises: a top panel; a vertical wall; a lateral wall; a bottom wall; a first ridge line; a second ridge line; a third ridge line; and a convergence portion. The top panel is a plate-like portion comprising a vertical edge and a lateral edge. The vertical wall is a plate-like portion extending from the vertical edge of the top panel. The lateral wall is a plate-like portion extending from the lateral edge of the top panel and is contiguous with the vertical wall. The bottom wall is a plate-like portion contiguous with the vertical wall and the lateral wall. The first ridge line forms a boundary between the vertical wall and the bottom wall. The second ridge line forms a boundary between the lateral wall and the bottom wall. The third ridge line forms a boundary between the lateral wall and the vertical wall. The convergence portion is connected to one end of each of the first, second, and third ridge lines. The bottom wall protrudes from the first ridge line toward a bulging side, and the lateral wall protrudes from the third ridge line toward the bulging side. The intermediate product comprises: the top panel; a pre-vertical wall; a pre-lateral wall; a pre-bottom wall; and an outward bulge. The pre-vertical wall is a plate-like portion extending from the vertical edge of the top panel. The pre-lateral wall is a plate-like portion extending from the lateral edge of the top panel. The pre-bottom wall is a plate-like portion contiguous with the pre-vertical wall and the pre-lateral wall. The outward bulge is a plate-like portion contiguous with the pre-vertical wall, the pre-lateral wall, and the pre-bottom wall. Moreover, the outward bulge is situated on the bulging side relative to the first and third ridge lines and intersects with a pre-second ridge line on the bulging side relative to the convergence portion, the pre-second ridge line forming a boundary between the pre-lateral wall and the pre-bottom wall. The outward bulge is deformed by press molding to form the press-molded part from the intermediate product.

According to the configuration as described, it is possible, because of the outward bulge formed in the intermediate product, to alleviate load concentration during press molding. Accordingly, occurrence of cracks or wrinkles during press molding can be reduced.

In one aspect of the present disclosure, an area situated closest to the top panel in a boundary of the outward bulge with the pre-lateral wall may be referred to as an apex. The apex may be situated in a neighborhood of the top panel.

According to the configuration as described, it is possible to further alleviate load concentration when performing press molding on the intermediate product. Accordingly, occurrence of cracks or wrinkles during press molding can be reduced in a more preferable manner.

In one aspect of the present disclosure, the outward bulge may include a top edge, which is an end located on an opposite side of the pre-bottom wall. The top edge may extend along the edge of the top panel.

According to the configuration as described, it is possible to further alleviate load concentration when performing press molding on the intermediate product. Accordingly, occurrence of cracks or wrinkles during press molding can be reduced in a more preferable manner.

In one aspect of the present disclosure, the press-molded part may be curved such that an end thereof in a direction of the first ridge line protrudes toward an opposite side of the bottom wall.

According to the configuration as described, occurrence of cracks or wrinkles during forming of the press-molded part can be reduced.

In one aspect of the present disclosure, the press-molded part may be made from a high-tensile steel having a tensile strength of 980 MPa or greater.

According to the configuration as described, occurrence of cracks or wrinkles during forming of the press-molded part can be reduced.

In one aspect of the present disclosure, the press-molded part may be made from a high-tensile steel having a tensile strength of 1470 MPa or greater.

According to the configuration as described, occurrence of cracks or wrinkles during forming of the press-molded part can be reduced.

In one aspect of the present disclosure, the convergence portion may be in a form of a point.

According to the configuration as described, occurrence of cracks or wrinkles during forming of the press-molded part can be reduced.

In one aspect of the present disclosure, the convergence portion may be in a form of a surface.

According to the configuration as described, occurrence of cracks or wrinkles during forming of the press-molded part can be reduced.

In one aspect of the present disclosure, the press-molded part may be installed in a vehicle.

According to the configuration as described, occurrence of cracks or wrinkles during forming of the press-molded part installed in the vehicle can be reduced.

In one aspect of the present disclosure, the press-molded part may be a member to make up a part of a vehicle body.

According to the configuration as described, occurrence of cracks or wrinkles during forming of the press-molded part making up a part of the vehicle body can be reduced.

BRIEF DESCRIPTION OF THE DRAWINGS

Example embodiments of the present disclosure will be described hereinafter by way of example with reference to the accompanying drawings, in which.

DETAILED DESCRIPTION OF THE PREFERRED EMBODIMENTS

Hereinafter, a description will be given of example embodiments of the present disclosure with reference to the drawings.

1. First Embodiment

(1) Press-Molded Part

Figure 1:
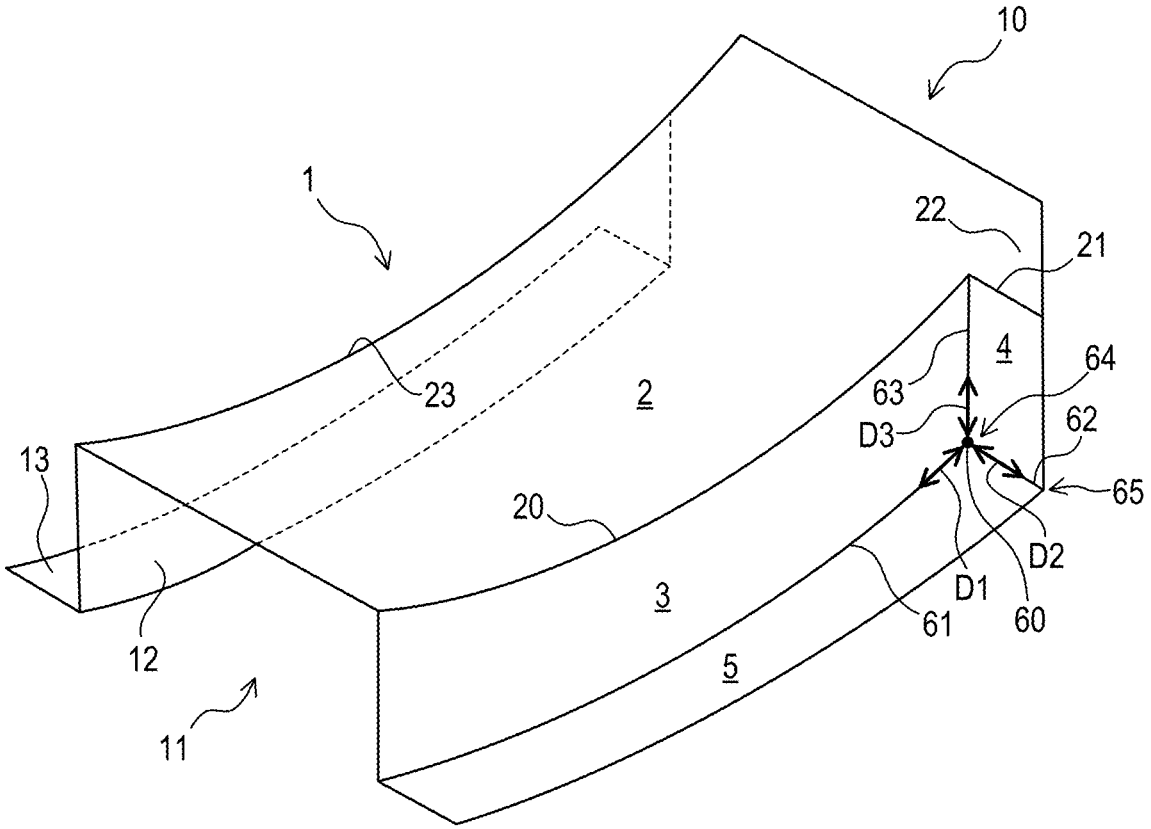
FIG. 1 is a perspective view of a press-molded part in a first embodiment.

A press-molded part 1 in a first embodiment is formed by performing press molding on a metal material (see, FIG. 1). In the first embodiment, the high-tensile steel having the tensile strength of 980 MPa or greater is used as the metal material. However, the metal material to be used is not limited to this, but may be, for example, a high-tensile steel having a tensile strength of 1470 MPa or greater, a high-tensile steel having a tensile strength of less than 980 MPa, a stainless steel, or an iron.

The press-molded part 1 is used, for example, as a member to make up a part of a vehicle body. However, the usage of the press-molded part 1 is not limited to this, but the press-molded part 1 may be used as a component to make up a part other than the vehicle body or as a member not to be installed in a vehicle.

The press-molded part 1 is a plate-like member comprising: a top panel 2; a vertical wall 3; a lateral wall 4; a bottom wall 5; a first wall 12; and a second wall 13. The press-molded part 1 also comprises first to third ridge lines 61 to 63 that extend in different directions from a convergence portion 60 that is in a form of a point, the details of which will be described later. Hereinafter, the directions in which the first to third ridge lines 61 to 63 extend are referred to as first to third directions D1 to D3.

The press-molded part 1 is groove-shaped and extends along the first directions D1 from a first edge 10 to a second edge 11. The press-molded part 1 has a curved shape such that the first edge 10 and the second edge 11 protrude toward an opposite side of the bottom wall 5, in other words, such that a center thereof in the first directions D1 protrudes toward the bottom wall 5. As a matter of course, the press-molded part 1 is not necessarily in the shape as described but may have a shape extending straight.

(2) Top Panel

The top panel 2 has a plate-like shape, extending from the first edge 10 to the second edge 11, and comprises: a vertical edge 20; a lateral edge 21; a projection 22; and an opposite edge 23 (see, FIG. 1). Similarly to the press-molded part 1, the top panel 2 may be curved such that both ends thereof in the first directions D1 protrude toward the opposite side of the bottom wall 5.

The vertical edge 20 is situated at an end of the top panel 2 in a width direction of the press-molded part 1 (hereinafter to be simply also referred to as the width direction) and extends along the first directions D1 from a vicinity of the first edge 10 to the second edge 11.

The projection 22 is situated in the vicinity of the first edge 10 of the top panel 2, protrudes along the second directions D2 from the end of the top panel 2 in the width direction, and has, for example, a substantially triangular shape.

The lateral edge 21 is an edge of the projection 22 and extends along the second directions D2 from an edge of the vertical edge 20 located closer to the first edge 10.

The opposite edge 23 is situated on an opposite side of the projection 22 in the top panel 2 and extends along the first directions D1 from the first edge 10 to the second edge 11. The opposite edge 23 faces the vertical edge 20 in the width direction.

(3) First and Second Walls

The first wall 12 has a plate-like shape and protrudes along the third directions D3 (see, FIG. 1) from the opposite edge 23.

The second wall 13 has a plate-like shape and protrudes along the second directions D2 from an edge opposite to the opposite edge 23 in the first wall 12. The second wall 13 is formed into, for example, a flange-like shape.

(4) Vertical Wall, Lateral Wall, and Bottom Wall

The vertical wall 3 has a plate-like shape and extends along the third directions D3 from the vertical edge 20 of the top panel 2. The vertical wall 3 extends along the first directions D1 and faces the first wall 12 in the width direction (see, FIG. 1).

The lateral wall 4 has a plate-like shape, extends along the third directions D3 from the lateral edge 21 of the top panel 2, and is contiguous with the vertical wall 3. The lateral wall 4 extends along the second directions D2 from an edge of the vertical wall 3 closer to the first edge 10.

The bottom wall 5 has a plate-like shape and is contiguous with the vertical wall 3 and the lateral wall 4. The bottom wall 5 stretches along the first and second directions D1, D2.

Each of the lateral wall 4 and the bottom wall 5 intersects with the vertical wall 3 at a specified angle and is formed into, for example, an elongated flange-like shape, extending along the edge of the vertical wall 3. The lateral wall 4 and the bottom wall 5 intersect with each other at a specified angle. The specified angle may be, for example, ranged from 90 degrees to 135 degrees.

A boundary between the vertical wall 3 and the bottom wall 5 forms the first ridge line 61. A boundary between the lateral wall 4 and the bottom wall 5 forms the second ridge line 62. A boundary between the lateral wall 4 and the vertical wall 3 forms the third ridge line 63. As previously described, the first to third ridge lines 61 to 63 extend from the convergence portion 60 in different directions, and the convergence portion 60 is contiguous with the vertical wall 3, the lateral wall 4, and the bottom wall 5. The bottom wall 5 extends from the first ridge line 61 toward an opposite side of the first wall 12 (in other words, a bulging side). The lateral wall 4 also extends from the third ridge line 63 toward the bulging side.

(5) Method for Manufacturing Press-Molded Part

The method for manufacturing the press-molded part 1 includes a first process and a second process.

Figure 2:
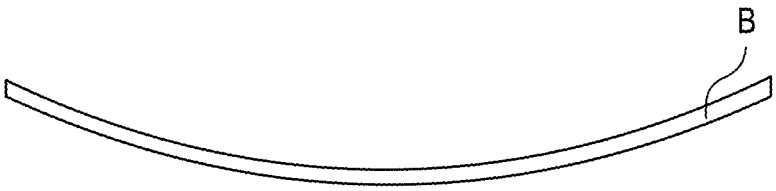
FIG. 2 is a side view of a blank material in the first embodiment.

In the first process, a blank material B with a plate-like shape (see, FIG. 2), which is formed from the aforementioned metal material, is subjected to press molding using a not-shown metallic mold to form an intermediate product 1A. For example, the blank material B is configured in a curved shape. However, the configuration of the blank material B is not limited to this but the blank material B may be in formed in a planar surface.

In the first process, the intermediate product 1A may be formed not only from the blank material B, but may also be formed by performing press molding on a plate-like material previously processed into a specified shape by press molding, etc.

In the second process, the intermediate product 1A is subjected to press molding using a not-shown metallic mold to form the press-molded part 1. Specifically, a later-described outward bulge 7 in the intermediate product 1A is deformed, thereby forming the press-molded part 1 from the intermediate product 1A. More specifically, the press-molded part 1 is formed by pressing the outward bulge 7 toward the convergence portion 60. In the second process, another portion besides the outward bulge 7 in the intermediate product 1A may be deformed to form the press-molded part 1.

(6) Intermediate Product

Figure 3:
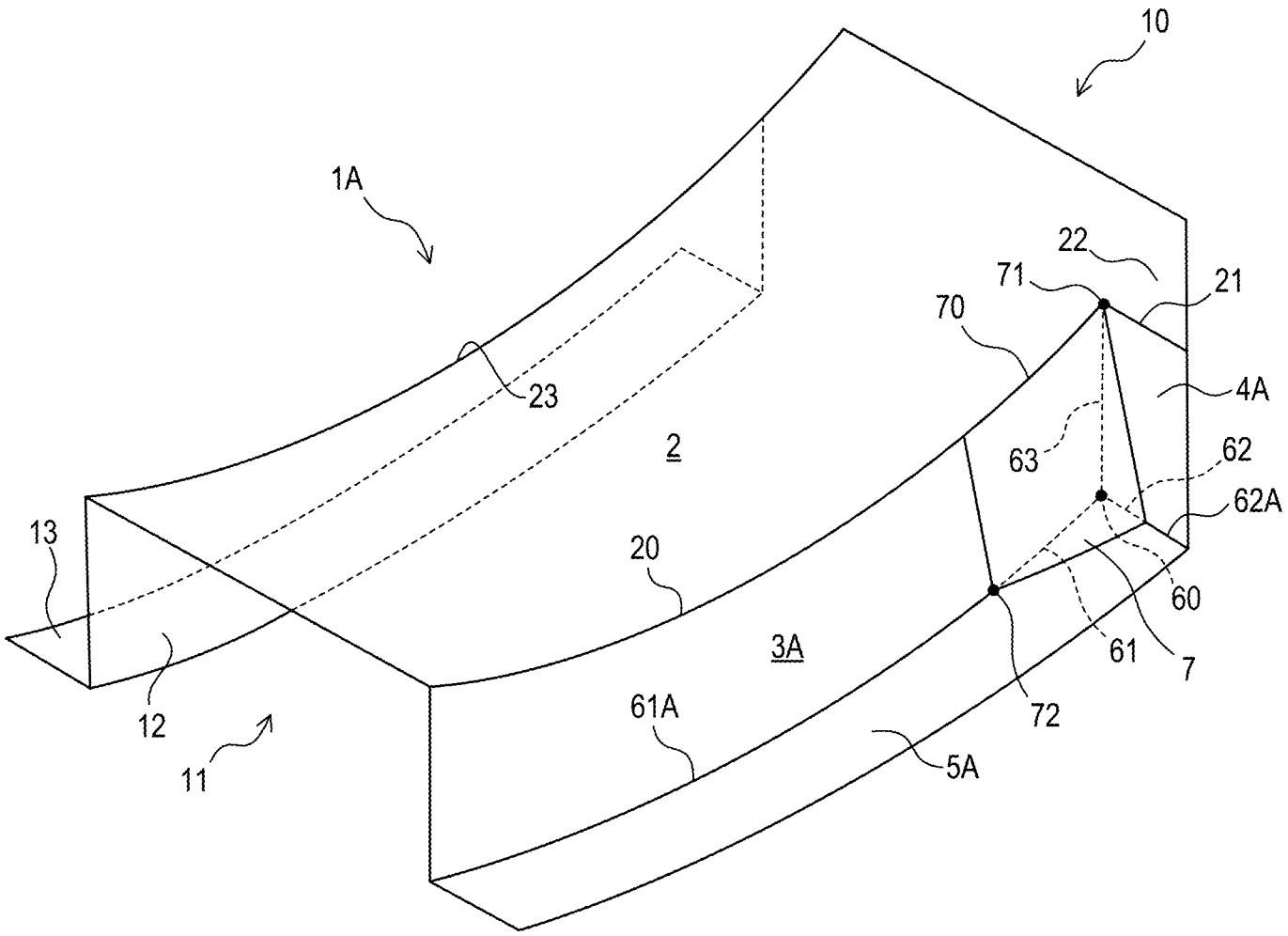
FIG. 3 is a perspective view of an intermediate product in a method for manufacturing the press-molded part in the first embodiment.

The intermediate product 1A has a shape similar to that of the press-molded part 1 but is different from the press-molded part 1 in that the intermediate product 1A comprises the outward bulge 7 at a peripheral area of the convergence portion 60 of the press-molded part 1 (see, FIG. 3). The intermediate product 1A comprises: the first wall 12; the second wall 13; the top panel 2; a pre-vertical wall 3A; a pre-lateral wall 4A; a pre-bottom wall 5A; and the outward bulge 7.

The first wall 12, the second wall 13, and the top panel 2 of the intermediate product 1A are configured similarly to the first wall 12, the second wall 13, and the top panel 2 of the press-molded part 1, respectively. The pre-vertical wall 3A, the pre-lateral wall 4A, and the pre-bottom wall 5A of the intermediate product 1A correspond to the vertical wall 3, the lateral wall 4, and the bottom wall 5 of the press-molded part 1, respectively. However, the intermediate product 1A comprises the outward bulge 7, which distinguishes the pre-vertical wall 3A, the pre-lateral wall 4A, and the pre-bottom wall 5A of the intermediate product 1A from the vertical wall 3, the lateral wall 4, and the bottom wall 5 of the press-molded part 1, respectively.

Specifically, the pre-vertical wall 3A, similarly to the vertical wall 3, has a plate-like shape, extends along the third directions D3 from the vertical edge 20 of the top panel 2, extends also along the first directions D1, and faces the first wall 12 in the width direction.

The pre-lateral wall 4A, similarly to the lateral wall 4, has a plate-like shape and extends along the third directions D3 from the lateral edge 21 of the top panel 2.

The pre-bottom wall 5A, similarly to the bottom wall 5, has a plate-like shape, is contiguous with the pre-vertical wall 3A and the pre-lateral wall 4A, and stretches along the first and second directions D1, D2.

The pre-lateral wall 4A and the pre-bottom wall 5A intersect with the pre-vertical wall 3A and the outward bulge 7, respectively, at specified angles, and are formed into, for example, a flange-like shape to be located at edges of the pre-vertical wall 3A and the outward bulge 7, respectively. The pre-lateral wall 4A and the pre-bottom wall 5A intersect with each other at a specified angle. The aforementioned specified angles may be, similarly to that of the press-molded part 1, ranged from 90 degrees to 135 degrees in one example.

However, the pre-vertical wall 3A and the pre-lateral wall 4A are not contiguous with each other, and the outward bulge 7 in a plate-like shape is provided between the pre-vertical wall 3A and the pre-lateral wall 4A. This distinguishes the intermediate product 1A from the press-molded part 1.

(7) Outward Bulge

The outward bulge 7 has a shape such that areas of the vertical wall 3, the lateral wall 4, and the bottom wall 5 on the periphery of the convergence portion 60 of the press-molded part 1 are bulged toward the aforementioned bulging side (see, FIG. 3).

The outward bulge 7 is situated between and contiguous with the pre-vertical wall 3A and the pre-lateral wall 4A and is also contiguous with a peripheral area of an edge of the pre-bottom wall 5A closer to the first edge 10. The outward bulge 7 is situated on the bulging side relative to the first and third ridge lines 61, 63 and the convergence portion 60 of the press-molded part 1. The outward bulge 7 intersects with a pre-second ridge line 62A on the bulging side relative to the convergence portion 60 of the press-molded part 1. The pre-second ridge line 62A is an element to form a boundary between the pre-lateral wall 4A and the pre-bottom wall 5A. A boundary between the outward bulge 7 and the pre-lateral wall 4A is situated on the bulging side relative to the third ridge line 63 of the press-molded part 1, and a boundary between the outward bulge 7 and the pre-bottom wall 5A is situated on the bulging side relative to the first ridge line 61 of the press-molded part 1. There is a pre-first ridge line 61A on a side closer to the second edge 11 relative to the outward bulge 7 to form a boundary between the pre-vertical wall 3A and the pre-bottom wall 5A.

In one example, the outward bulge 7 is formed into a planar surface. However, the configuration of the outward bulge 7 is not only this, but may have a curved shape in another example. The outward bulge 7 in one example is substantially quadrangular when viewed from front.

An area situated closest to the top panel 2 in the boundary of the outward bulge 7 with the pre-lateral wall 4A is to be referred to as an apex 71. The apex 71 is situated in a neighborhood of the top panel 2. Specifically, the apex 71 is situated on the vertical edge 20 of the top panel 2. However, the position of the apex 71 is not limited to this, but the apex 71 may be located at a position slightly distant from the vertical edge 20.

An edge forming a side of the outward bulge 7 opposite to the pre-bottom wall 5A (hereinafter to be referred to as a top edge 70) extends along the vertical edge 20 of the top panel 2. Specifically, the top edge 70 is situated on the vertical edge 20. However, the position of the top edge 70 is not limited to this, but there may be a slight distance provided between the top edge 70 and the vertical edge 20.

Moreover, there may be a distance provided between the top edge 70 and the vertical edge 20. Specifically, the top edge 70 may be located, for example, on a periphery of the pre-bottom wall 5A. That is to say, the pre-vertical wall 3A and the pre-lateral wall 4A may be contiguous with each other at an adjacent position to the outward bulge 7 on the side closer to the top panel 2.

2. Second Embodiment

Figure 4:
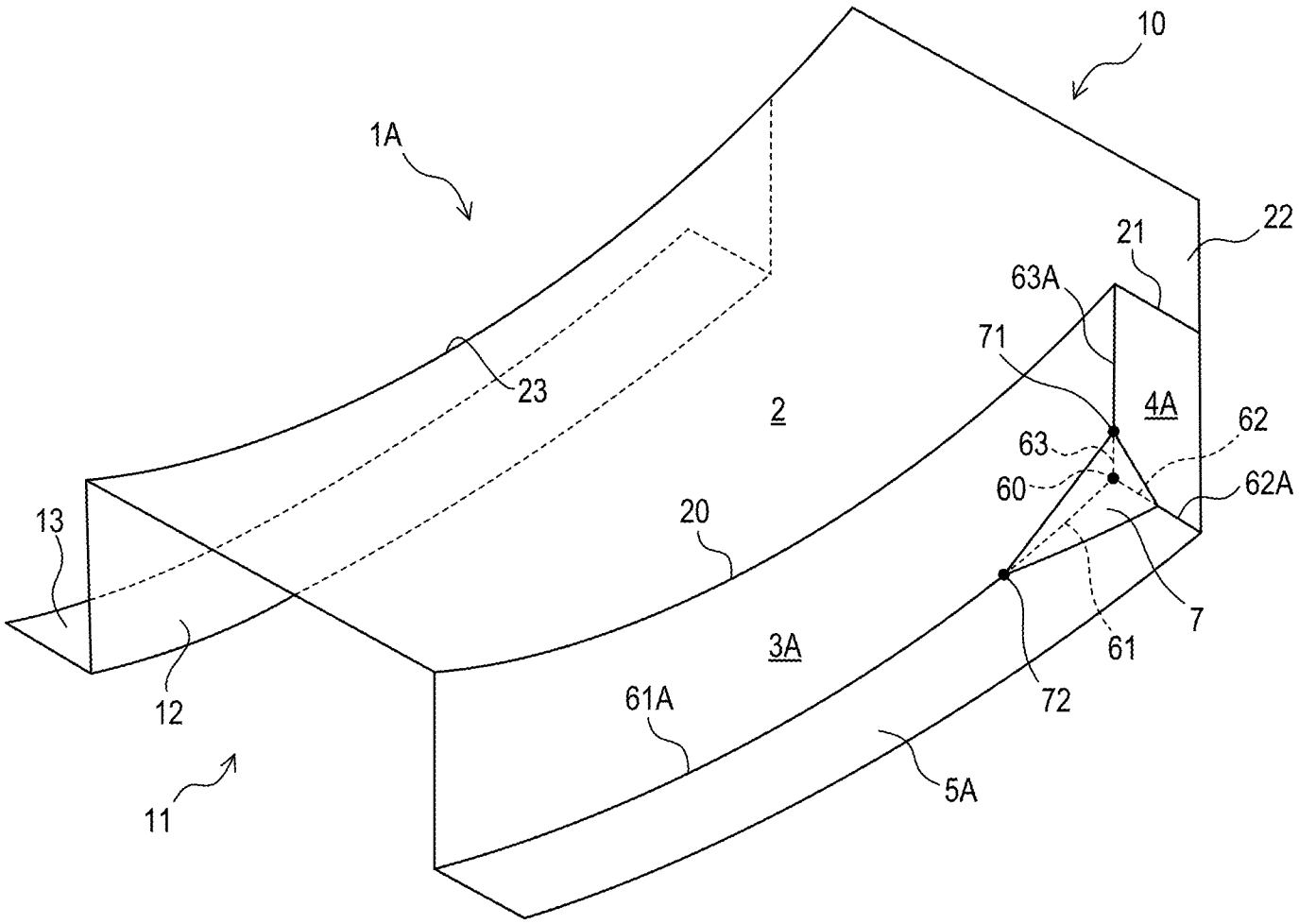
FIG. 4 is a perspective view of an intermediate product in a method for manufacturing a press-molded part in a second embodiment.

The method for manufacturing the press-molded part 1 in the second embodiment is different from that in the first embodiment in the shape of the outward bulge 7 of the intermediate product 1A (see, FIG. 4). Hereinafter, descriptions will be given of differences between the intermediate product 1A in the second embodiment and that in the first embodiment.

In the second embodiment, likewise in the first embodiment, the outward bulge 7 has a shape such that areas of the vertical wall 3, the lateral wall 4, and the bottom wall 5 on the periphery of the convergence portion 60 of the press-molded part 1 are bulged toward the bulging side. In other words, the outward bulge 7 is situated, similarly to that in the first embodiment, on the bulging side relative to the first and third ridge lines 61, 63, and the convergence portion 60 of the press-molded part 1. The outward bulge 7 intersects with the pre-second ridge line 62A on the bulging side relative to the convergence portion 60 of the press-molded part 1. The boundary between the outward bulge 7 and the pre-lateral wall 4A is situated on the bulging side relative to the third ridge line 63 of the press-molded part 1, and the boundary between the outward bulge 7 and the pre-bottom wall 5A is situated on the bulging side relative to the first ridge line 61 of the press-molded part 1.

However, in the second embodiment, the outward bulge 7 is substantially triangular in one example when viewed from the front, and is, similarly to that in the first embodiment, contiguous with the pre-vertical wall 3A and the pre-lateral wall 4A and also to the peripheral area of the edge of the pre-bottom wall 5A closer to the first edge 10.

In the second embodiment, the pre-vertical wall 3A and the pre-lateral wall 4A are contiguous with each other on the side closer to the top panel 2 relative to the outward bulge 7, and a pre-third ridge line 63A to form a boundary between the pre-vertical wall 3A and the pre-lateral wall 4A extends from a boundary between the vertical edge 20 and the lateral edge 21 toward the pre-bottom wall 5A. An area forming an apex in the outward bulge 7 (hereinafter to be referred to as the apex 71), in other words, the area located closest to the top panel 2 in the boundary of the outward bulge 7 with the pre-lateral wall 4A is located at the end of the pre-third ridge line 63A.

In one example, the apex 71 is located on a periphery of the converging portion 60 of the press-molded part 1, in other words, on a periphery of the pre-bottom wall 5A. However, the position of the apex 71 is appropriately determined, and the apex 71 may be located, for example, in a neighborhood of the top panel 2, specifically, on the vertical edge 20 or at a position slightly distant from the vertical edge 20.

3. Modified Examples

In the first and second embodiments, the convergence portion 60 of the press-molded part 1 is in the form of a point. However, the convergence portion 60 may be configured in the form of a surface and may be situated on the bulging side relative to an intersecting point of virtual lines that are extended from the first to third ridge lines 61 to 63 (hereinafter to be referred to as a virtual intersecting point). In other words, the convergence portion 60 in a modified example may be formed into a shape as if beveling was performed on the converging portion 60 in the form of a point in the first and second embodiments.

Figure 5:
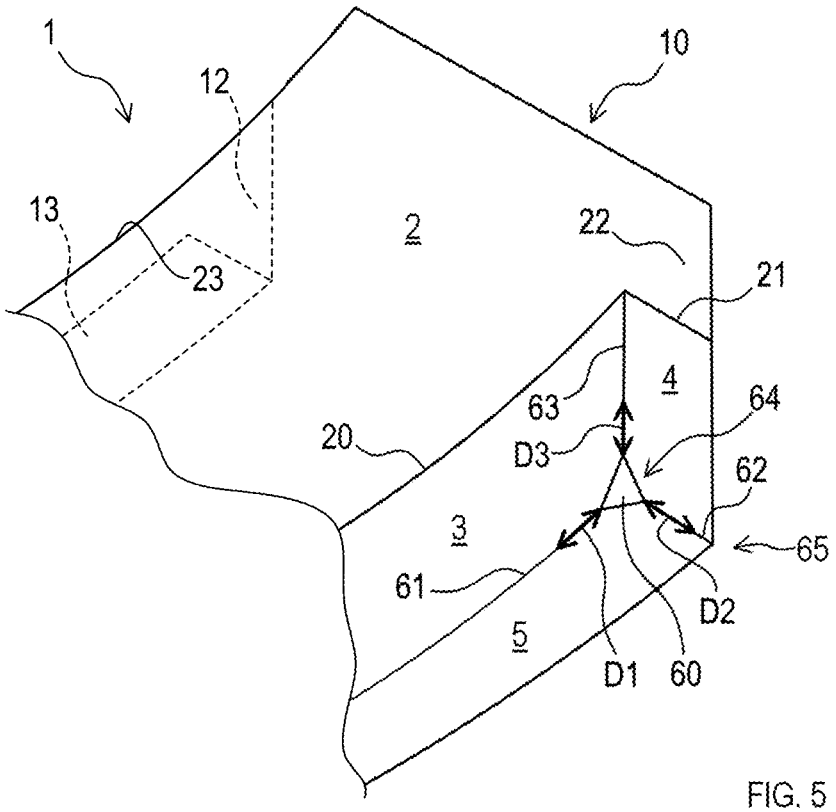
FIG. 5 is a perspective view of a convergence portion of modified examples in the first and second embodiments.

In one example, the converging portion 60 has a shape as if C chamfering was performed on the area where the first to third ridge lines 61 to 63 intersect together and is formed into a substantially triangular planar surface (see, FIG. 5). One end of each of the first to third ridge lines 61 to 63 is connected to an area forming each of the apexes of the converging portion 60, and areas forming sides of the converging portion 60 are each contiguous with the vertical wall 3, the lateral wall 4, and the bottom wall 5.

Moreover, the convergence portion 60 may have a shape, for example, as if round chamfering was performed on an area where the first to third ridge lines 61 to 63 intersect together and may be formed into a curved surface. One end of each of the first to third ridge lines 61 to 63 may be connected to the convergence portion 60.

In the second process, when forming the press-molded part 1 from the intermediate product 1A, likewise in the first and second embodiments, the outward bulge 7 of the intermediate product 1A is pressed, thereby forming the convergence portion 60. Accordingly, the convergence portion 60 is smaller than the outward bulge 7 and is situated closer to the virtual intersecting point of the first to third ridge lines 61 to 63 than the outward bulge 7.

4. Effects (1) In a case where the press-molded part 1 is formed from the blank material B by one single performance of press molding, cracks may occur at peripheral areas of the convergence portion 60 (hereinafter to be referred to as a convergence portion periphery 64), and wrinkles may occur at peripheral areas of the end of the second ridge line 62 opposite to the convergence portion 60 (hereinafter to be referred to as an outer end 65) (see, FIG. 1). The reasons for these are that the convergence portion periphery 64 of the press-molded part 1 is an area where the three surfaces converge, and the angles formed by the intersecting surfaces are acute. As such, when performing press molding, material movement is liable to be restricted at the convergence portion periphery 64, and a contact point is formed in the neighborhood of the convergence portion 60, resulting in a tendency for loads to be easily concentrated on the convergence portion periphery 64. The contact point is a portion subjected to a relatively heavy load during press molding. For example, a portion to abut a metallic mold at an initial stage of press molding may become the contact point.

It is conceived to reduce the load on the convergence portion periphery 64 during press molding in order to reduce occurrence of cracks in the convergence portion periphery 64 of the press-molded part 1. However, by doing so, a plate thickness of the convergence portion periphery 64 does not decrease, making it difficult for the material accumulated in the outer end 65 to move to the convergence portion periphery 64. This may facilitate occurrence of wrinkles at the outer end 65.

On the other hand, in the manufacturing method in the aforementioned embodiments, the intermediate product 1A comprises the outward bulge 7 in the periphery of the area in the press-molded part 1 where the convergence portion periphery 64 is formed, which reduces the angles formed by the intersecting surfaces. Because of this, first, in press molding in the first process, the contact point is formed at a position in the blank material B corresponding to a bottom point 72 of the intermediate product 1A. What is meant by the bottom point 72 is an intersecting point of the outward bulge 7 and the pre-first ridge line 61A. As a result of this, the contact point is easily displaced in the blank material B during the press molding in the first process, and thus it is possible to alleviate excessive load concentration in a peripheral area of the bottom point 72 and to moderately reduce the plate thickness of the said area.

Figure 6:
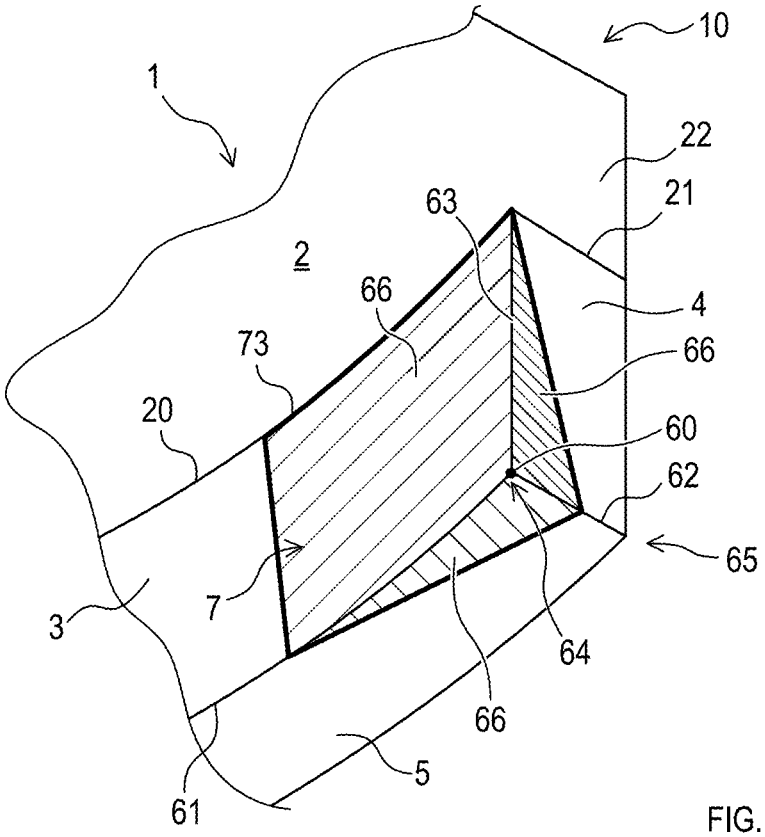
FIG. 6 is an explanatory diagram of an outward bulge and a covered area in the first embodiment.

Furthermore, in press molding in the second process, the contact point is formed on the planar outward bulge 7 of the intermediate product 1A, which promotes displacement of the contact point, and thus load concentration is alleviated. Furthermore, the peripheral area of the bottom point 72 in the intermediate product 1A has the reduced plate thickness, and thus movement of the material from the outer end 65 to the said area is promoted. An area of the outward bulge 7 is smaller than an area of plate-like shape portion enclosed by a line corresponding to an outer edge 73 of the outward bulge 7 in the press-molded part 1 (hereinafter to be referred to as a covered area 66) (see, FIG. 6). In other words, during the press molding in the second process, the outward bulge 7 is deformed, thereby forming the covered area 66. However, the area of the covered area 66 is larger than the area of the outward bulge 7, and accordingly a plate thickness of the covered area 66 is smaller than a plate thickness of the outward bulge 7. This promotes movement of the material from the outer end 65 to the covered area 66.

Because of this, in the press-molded part 1, decrease in plate thicknesses of a peripheral area of a position corresponding to the bottom point 72 and of the convergence portion periphery 64 and increase in the plate thickness of the outer end 65 can be controlled to be within acceptable levels. As a result of this, occurrence of cracks at the convergence portion periphery 64 and occurrence of wrinkles at the outer end 65 in the press-molded part 1 can be reduced.

(2) In the first embodiment, the apex 71 of the outward bulge 7 is situated in the neighborhood of the top panel 2, and the top edge 70 of the outward bulge 7 extends along the vertical edge 20. This makes it possible that the contact point on the outward bulge 7 of the intermediate product 1A is formed at a position further away from the position corresponding to the convergence portion 60 in the press molding in the second process. This further promotes displacement of the contact point, and thus load concentration can be more favorably alleviated. This also enables to sufficiently leave the area of the outward bulge 7, resulting in a large difference between the area of the outward bulge 7 and the area of the covered area 66. Accordingly, movement of the material from the outer end 65 to the covered area 66 is promoted in the press molding in the second process. Therefore, in the press molding in the second process, it is possible to reduce cracks at the convergence portion periphery 64 and wrinkles at the outer end 65 in the press-molded part 1 in a more preferable manner.

(3) If forming the press-molded part 1 from the blank material B by one single performance of press molding, load is easily concentrated on the convergence portion periphery 64 as the press-molded part 1 in the aforementioned embodiments has a curved shape. As a result of this, cracks are likely to occur at the convergence portion periphery 64, and wrinkles are likely to occur at the outer end 65. On the other hand, the first process for forming the intermediate product 1A comprising the outward bulge 7 in the aforementioned embodiments effectively reduces occurrence of cracks at the convergence portion periphery 64 and occurrence of wrinkles at the outer end 65 in the press-molded part 1.

(4) The press-molded part 1 in the aforementioned embodiments is made from the high-tensile steel having the tensile strength of 980 MPa or greater. Due to this, cracks easily occur at the convergence portion periphery 64, and wrinkles easily occur at the outer end 65. On the other hand, the first process for forming the intermediate product 1A comprising the outward bulge 7 in the aforementioned embodiments effectively reduces occurrence of cracks at the convergence portion periphery 64 and occurrence of wrinkles at the outer end 65 the press-molded part 1.

5. Other Embodiments (1) In the embodiments described above, the lateral wall 4 and the bottom wall 5 of the press-molded part 1 are formed into an elongated flange-like shape extending along the edge of the vertical wall 3. However, the lateral wall 4 and the bottom wall 5 do not necessarily have a flange-like shape, but may be in the form of a surface stretching from the edge of the vertical wall 3.

(2) A plurality of functions of a single component in the above embodiments may be achieved by a plurality of components, or a single function of a single component may be achieved by a plurality of components. Further, a plurality of functions of a plurality of components may be achieved by a single component, or a single function of a plurality of components may be achieved by a single component. It is also possible to omit a part of the configuration of the above-described embodiments. Further, at least part of the configuration of any of the above-described embodiments the component of any of the above embodiments may be added or substituted to the other of the embodiments.

6. Technical Ideas Disclosed Herein

Item 1

A method for manufacturing a press-molded part, the method comprising:

forming an intermediate product by performing press molding on a plate-like shaped material; and forming a press-molded part by performing press molding on the intermediate product, wherein the press-molded part comprises:

a top panel with a plate-like shape, including a vertical edge and a lateral edge;

a vertical wall with a plate-like shape, extending from the vertical edge of the top panel;

a lateral wall with a plate-like shape, extending from the lateral edge of the top panel and being contiguous with the vertical wall;

a bottom wall with a plate-like shape, being contiguous with the vertical wall and the lateral wall;

a first ridge line to form a boundary between the vertical wall and the bottom wall;

a second ridge line to form a boundary between the lateral wall and the bottom wall;

a third ridge line to form a boundary between the lateral wall and the vertical wall; and a convergence portion in a form of a point or a surface, connected to one end of each of the first, second, and third ridge lines, the bottom wall protruding toward a bulging side from the first ridge line, the lateral wall protruding toward the bulging side from the third ridge line, the intermediate product comprising:

the top panel;

a pre-vertical wall with a plate-like shape, extending from the vertical edge of the top panel;

a pre-lateral wall with a plate-like shape, extending from the lateral edge of the top panel;

a pre-bottom wall with a plate-like shape, being contiguous with the pre-vertical wall and the pre-lateral wall; and an outward bulge with a plate-like shape, being contiguous with the pre-vertical wall, the pre-lateral wall, and the pre-bottom wall, the outward bulge being situated on the bulging side relative to the first and third ridge line and intersecting with a pre-second ridge line that forms a boundary between the pre-lateral wall and the pre-bottom wall on the bulging side relative to the convergence portion, and wherein the outward bulge is deformed by press molding to form the press-molded part from the intermediate product.

Item 2

The method for manufacturing a press-molded part according to Item 1, wherein an area situated closest to the top panel in a boundary of the outward bulge with the pre-lateral wall is an apex, the apex being situated in a neighborhood of the top panel.

Item 3

The method for manufacturing a press-molded part according to Item 1 or 2, wherein the outward bulge comprises a top edge that is an end located on an opposite side of the pre-bottom wall, the top edge extending along an edge of the top panel.

Item 4

The method for manufacturing a press-molded part according to any one of Items 1 to 3, wherein the press-molded part is curved such that an end thereof in a direction of the first ridge line protrudes toward an opposite side of the bottom wall.

Item 5

The method for manufacturing a press-molded part according to any one of Items 1 to 4, wherein the press-molded part is made from a high-tensile steel having a tensile strength of 980 MPa or greater.

What is claimed is:

1. A method for manufacturing a press-molded part, the method comprising:

a step of forming an intermediate product by performing press molding on a plate-like shaped material; and a step of forming a press-molded part by performing press molding on the intermediate product, wherein the intermediate product comprises:

a top panel with a plate-like shape, including a vertical edge and a lateral edge;

a pre-vertical wall with a plate-like shape, extending from the vertical edge of the top panel of the intermediate product;

a pre-lateral wall with a plate-like shape, extending from the lateral edge of the top panel of the intermediate product;

a pre-bottom wall with a plate-like shape, being contiguous with the pre-vertical wall and the pre-lateral wall; and an outward bulge with a plate-like shape, being contiguous with the pre-vertical wall, the pre-lateral wall, and the pre-bottom wall, wherein the press-molded part comprises:

a top panel with a plate-like shape, including a vertical edge and a lateral edge;

a vertical wall with a plate-like shape, extending from the vertical edge of the top panel of the press-molded part;

a lateral wall with a plate-like shape, extending from the lateral edge of the top panel of the press-molded part and being contiguous with the vertical wall of the press-molded part;

a bottom wall with a plate-like shape, being contiguous with the vertical wall of the press-molded part and the lateral wall of the press-molded part;

a first ridge line to form a boundary between the vertical wall of the press-molded part and the bottom wall of the press-molded part;

a second ridge line to form a boundary between the lateral wall of the press-molded part and the bottom wall of the press-molded part;

a third ridge line to form a boundary between the lateral wall of the press-molded part and the vertical wall of the press-molded part; and a convergence portion connected to one end of each of the first, second, and third ridge lines of the press-molded part, the bottom wall of the press-molded part protruding toward a bulging side of the press-molded part from the first ridge line, the lateral wall of the press-molded part protruding toward the bulging side of the press-molded part from the third ridge line, an outward bulge with a plate like shape, being contiguous with the pre vertical wall, the pre lateral wall, and the pre bottom wall, the outward bulge of the intermediate product being situated on a bulging side of the intermediate product relative to the first and third ridge line of the press-molded part and intersecting with a pre-second ridge line of the intermediate product that forms a boundary between the pre-lateral wall and the pre-bottom wall on the bulging side of the intermediate product relative to the convergence portion of the press-molded part, and wherein the outward bulge is deformed by press molding to form the press-molded part from the intermediate product.

2. The method for manufacturing the press-molded part according to claim 1, wherein an area situated closest to the top panel of the intermediate product in a boundary of the outward bulge with the pre-lateral wall is an apex, the apex being situated in a neighborhood of the top panel of the intermediate product.

3. The method for manufacturing the press-molded part according to claim 1, wherein the outward bulge comprises a top edge that is an end located on an opposite side of the pre-bottom wall, the top edge extending along an edge of the top panel of the intermediate product.

4. The method for manufacturing the press-molded part according to claim 1, wherein the press-molded part is curved such that an end thereof in a direction of the first ridge line protrudes toward an opposite side of the bottom wall.

5. The method for manufacturing the press-molded part according to claim 1, wherein the press-molded part is made from a high-tensile steel having a tensile strength of 980 MPa or greater.

6. The method for manufacturing the press-molded part according to claim 5, wherein the press-molded part is made from a high-tensile steel having a tensile strength of 1470 MPa or greater.

7. The method for manufacturing the press-molded part according to claim 1, wherein the convergence portion is in a form of a point.

8. The method for manufacturing the press-molded part according to claim 1, wherein the convergence portion is in a form of a surface.

9. The method for manufacturing the press-molded part according to claim 1, wherein the press-molded part is installed in a vehicle.

10. The method for manufacturing the press-molded part according to claim 9, wherein the press-molded part is a member to make up a part of a vehicle body.

* * * * *